US006503448B1

(12) United States Patent
Kuhfeldt et al.

(10) Patent No.: US 6,503,448 B1
(45) Date of Patent: Jan. 7, 2003

(54) PROCESS FOR RETARDING THE FORMATION OF CORROSION ON METAL SURFACES

(75) Inventors: Charles D. Kuhfeldt, Taylor Lake Village; James M. Bryson, The Woodlands, both of TX (US)

(73) Assignee: Ashland Inc., Covington, KY (US)

( * ) Notice: Subject to any disclaimer, the term of this patent is extended or adjusted under 35 U.S.C. 154(b) by 0 days.

(21) Appl. No.: 09/321,354

(22) Filed: May 27, 1999

Related U.S. Application Data

(60) Provisional application No. 60/088,047, filed on Jun. 3, 1998.

(51) Int. Cl.[7] ..... C23F 11/02; C23F 11/14

(52) U.S. Cl. ..... 422/11; 422/16

(58) Field of Search ..... 422/16, 14, 11; 252/178, 392

(56) References Cited

U.S. PATENT DOCUMENTS 3,269,715 A * 8/1966 Wellford, Jr.

4,487,745 A * 12/1984 Weiss et al. ..... 422/16

OTHER PUBLICATIONS

Schiller, K. Abstract of "Disposal of chemical production residue at BASF [Badische Anilin– und Soda–Fabrik] – organization and experience," Mitt. Ver. Grosskesselbetr., (1971), 51(2), pp. 123–130.*

Rumpf, R. R. Abstract of "Updated on the application of methyl ethyl ketoxime for corrosion control in high pressure steam generating systems," R. R. Rumpf, Paper No. 147, Presented at Corrosion/92 (Apr. 26 to May 1, 1992, Nashville, TN).*

* cited by examiner

*Primary Examiner*—Elizabeth McKane
(74) *Attorney, Agent, or Firm*—David L. Hedden

(57) ABSTRACT

The invention relates to a process for retarding the formation of corrosion and/or removing existing corrosion deposits on a metal surface where the metal is in contact with air. The process comprises contacting said metal surface with an oxime in an amount effective to retard the formation of corrosion on the metal surface.

8 Claims, 1 Drawing Sheet

PROCESS FOR RETARDING THE FORMATION OF CORROSION ON METAL SURFACES

Figure 1:
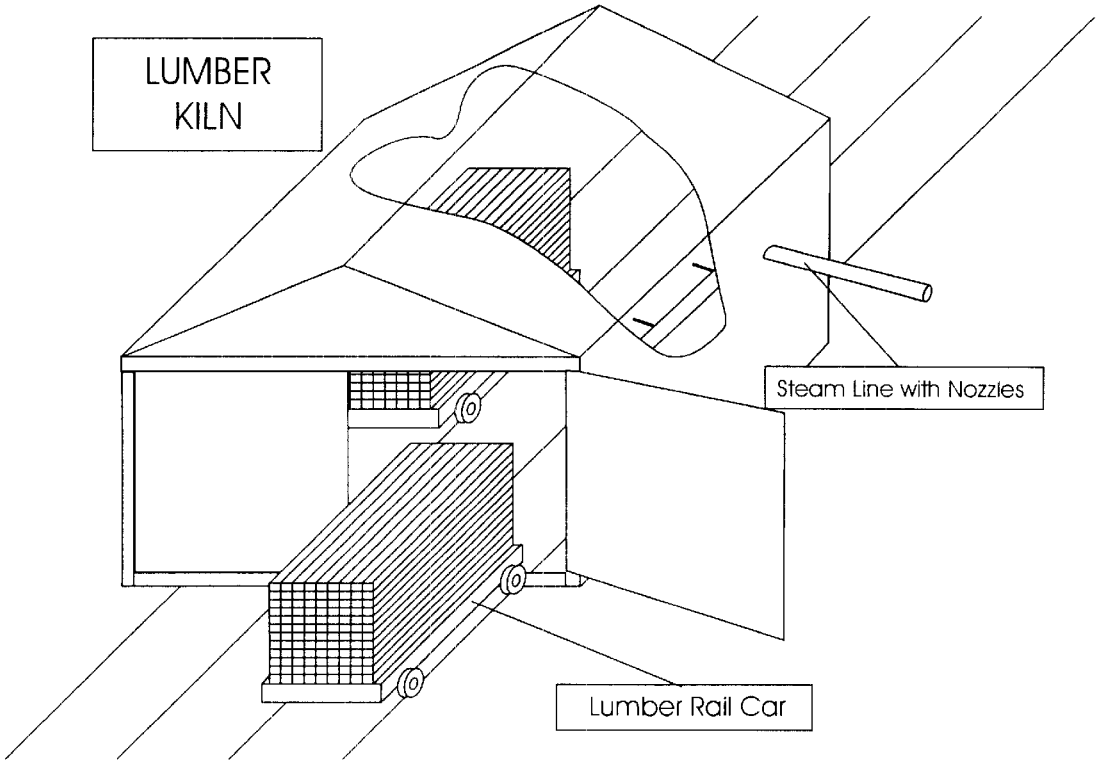

This application claims priority from provisional application No. 60/088,047, filed Jun. 3, 1998.

FIELD OF THE INVENTION

The invention relates to a process for retarding the formation of corrosion and/or removing existing corrosion deposits on a metal surface where the metal is in contact with air. The process comprises contacting said metal surface with an oxime in an amount effective to retard the formation of corrosion on the metal surface.

BACKGROUND OF THE INVENTION

The formation of corrosion (typically $Fe_2O_3$, commonly known as rust) on metals is a problem whenever metals are exposed to oxygen and/or moisture. It is known that methyl ethyl ketoxime (MEKO) can be applied to "closed aqueous systems" such as boilers, which are mechanically deoxygenated systems, to protect the interior surface of a metal tube, pipe, or other enclosure. The typical dosage of MEKO used to control corrosion in a utility circuit, such as boiler, is from 30–80 ppb. It is believed that MEKO controls corrosion in the feedwater circuit of the boiler by scavenging oxygen and forming a corrosion-resistant oxide film on the waterside metallic surfaces. See, for instance, U.S. Pat. No. 4,487,745. In such closed systems, the amount of oxygen is minute. For instance, boiler water contains less than 100 pbb of oxygen, typically contains less than 10 ppb of oxygen, so there is little oxygen for the MEKO to scavenge.

In contrast to such a system, an "open system" for purposes of this disclosure is one where the outer surface of the metal comes into contact with air. Air is known to contain about 19.8% by weight oxygen or 198,000,000 ppb. In view of this great amount of oxygen, it is not believed that MEKO would effectively retard corrosion of surface metals in a open system exposed to air.

A kiln is an open heating system with a refractory lined chamber used for the calcination of lime, magnesia, cement, and ores. Kilns are used for drying lumber where they function as a large oven-like chamber in which temperature, air moisture, and air circulation are regulated to allow proper drying of the lumber. A lumber kiln is a large oven like chamber which does not have refractory or even insulation in may cases. The structural members and sometimes the walls are bare, unpainted and uncoated steel.

Kilns are used to dry lumber in order to reduce the tendency of the lumber to rot and to control bending, cracking and splitting of the lumber in use. Lumber in a kiln is typically dried with steam produced by heating water with natural gas, wood waste products or hot oil. The steam is directly injected into the kiln through perforated pipes, by atomized sprays, or through coils which heat the lumber. Roof ventilators open, when the humidity of the kiln is too high, to let damp hot air out and cold air containing air into the kiln chamber.

Kilns have several openings where air can enter. These openings are typically found at the top and the sides of the kiln. In addition to refractory materials, a kiln contains many metal components for support. Typically these metal supports are made of steel and are subject to corrosion by incoming air and moisture.

FIG. 1

FIG. 1 is a drawing of a kiln showing where MEKO was added to the feedwater stream in Example 1. Components of the kiln are a chamber for drying wood, side doors where wood enters chamber, stacks of wood for drying, top vents for allowing air to enter and exit, heating coils, fans, and steam spray lines.

SUMMARY OF THE INVENTION

This invention relates to a process for retarding the formation of corrosion and/or reducing existing corrosion deposits on a metal surface exposed to air, where said process comprises:

contacting said metal surface, which is contact with air, with an oxime in an amount effective to retard the formation of corrosion on the metal surface.

The process is particularly useful for retarding the formation of corrosion on metal surfaces found in a open heating system, particularly a kiln for drying lumber, but it is believed the process will can be used in other open systems where uncoated metal surfaces need protection from corrosion due to the oxygen in air. Typically the metal surfaces in the kiln are made of steel, more particularly mild carbon steel. Often steam is used in the kiln to dry the lumber, and the steam is typically generated by the burning of natural gas, wood waste products or hot oil.

Contacting the metal surface with the oxime forms a protective layer on the metal which is apparent from changes in the color and surface texture of the metal surface. It is surprising that these changes occur in the presence of air since there is so much oxygen in the air that the oxime could not effectively scavenge a significant portion of it.

The protective layer formed on the metal surface is sufficiently adherent and tenacious to retard further formation of corrosion. As a result, the useful life of the surface metal in the kiln is extended, and the maintenance and replacement of metal surfaces is reduced. Cost savings result because operating equipment lasts longer and need not be cleaned as frequently.

BEST MODE AND OTHER MODES

For purposes of describing this invention, an "open system" is a system where the metal is in contact with air. Typically the metal will also be exposed to moisture and contaminants. The open system of particular interest is an open heating system where heat is used to generate steam, more particularly a kiln for drying wood. In an open system the outer surface of the metal to be treated comes into contact with the oxygen in air.

The oximes used in this process are described in U.S. Pat. No. 4,487,745 which is hereby incorporated by reference and shown by the following chemical structure:

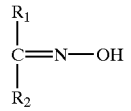

wherein $R_1$ and $R_2$ are the same or different and are selected from hydrogen, lower alkyl groups of 1–8 carbon atoms and aryl groups, and mixture thereof, particularly aliphatic oximes. Most preferably used as the oxime is methyl ethyl ketoxime (MEKO). The oxime is preferably added to a feedpoint which will expose the said methyl ethyl ketoxime to a temperature of about 30° C. to about 320° C. In addition to oximes, it is believed hydroxylamines such as diethylhydroxlyamine, can also be used in this process.

The oxime is added to any feedpoint which will bring the oxime into contact with the metal surface. Typically, the feedpoint is the pipes or atomizers where steam is generated and sprayed into the open heating system. However, the oxime can even be added to boiler water or any other feedpoint, as long the oxime eventually comes into contact with the metal surfaces exposed to oxygen.

The typical dosage of oxime used in an aqueous system for feedwater oxygen scavenging is in the range of 50 to 500 ppb, preferably from 50 to 200 ppb. The dosage in the open system is from 20 to 40 times higher than the lower dosage used in boiler feed water to control corrosion in the boiler system. In other words, the dosage of oxime needed to reduce corrosion in an open system is at least 1,000 ppb, preferably at least 1,500 ppb, and most preferably, at least 2,000 ppb. However, the oxime dosage, in most cases, would not be expected to exceed 5,000 ppb. Typically, the oxime dosage is maintained in an operating system for the entire period in which steam is injected into the kiln. This would be preferably for a minimum of 8 hours, preferably from 1 to 2 days.

Although it is possible to use the subject process for treating other open systems, it is particularly useful for treating the metal surfaces of kilns which come into contact with air. In the case of kilns, the oxime is preferably injected into a steam line just prior to entering the kiln and is used during the period when the lumber is heated and dried in the kiln.

Heat is applied in the kiln by steam heating either by transfering steam through coils, or by direct steam heating. Direct steam heating involves injecting steam into the kiln through pipes or nozzles arrayed around the kiln to give full exposure. This type of kiln creates severe problems with respect to corrosion. Corrosion before and after treatment with the oxime is measured with equipment well known in the art, e.g. by using a corrosimeter or a corrator.

EXAMPLE

MEKO was tested in large rectangular kilns approximately 120' long, 40' wide, and 20' high. The kiln has a concrete foundation with mild carbon steel structural supports, side rails, and side walls, with openings at the bottom, sides, and top of the kiln. The steel surfaces of the structural supports and side walls of the kiln are corroded badly with rust and will need to be replaced soon. Air and moisture enter the openings of the kiln and come into contact with the metal surfaces of the kiln.

Lumber is brought into the drying chamber of the kiln on railcars through the steel framed doors. The temperature, humidity, and air circulation of the drying chamber of the kiln is regulated by computers and sensing devices. The lumber is dried with steam which is directly injected into the kiln and surrounds the lumber. The lumber is dried in the kiln until the proper moisture content for the wood is reached.

The MEKO is injected during every lumber drying period, but the drying periods are variable. Observations of the carbon steel surface treated with MEKO show that a protective layer formed over the metal surfaces of the kiln and the growth of corrosion growth is significantly reduced. The result is that structural strength of the carbon steel metal is maintained and its replacement time is greatly reduced.

We claim:

1. A process for retarding the formation of corrosion and/or removing existing corrosion deposits on a metal surface exposed to air where said process comprises:

contacting said metal surface in contact with air with an oxime in an amount effective to retard the formation of corrosion and/or remove existing corrosion on the metal surface, wherein the metal surface is found in an open heating system.

2. The process of claim 1 wherein the open heating system is a kiln.

3. The process of claim 2 wherein the metallic surfaces are part of a kiln.

4. The process of claim 3 wherein the oxime is methyl ethyl ketoxime.

5. The process of claim 4 wherein the open heating system generates or utilizes steam for drying.

6. The process of claim 5 wherein the methyl ethyl ketoxime is added to the system in a dosage of at least 1,000 ppb.

7. The process of claim 6 wherein the oxime is added to a source of steam in the kiln having a temperature above 65° C.

8. The process of claim 7 wherein the methyl ethyl ketoxime is added to the aqueous stream at a dosage of at least 1,500 ppb.

* * * * *